United States Patent [19]

Smith

[11] 4,373,929

[45] Feb. 15, 1983

[54] METHOD AND APPARATUS FOR CUTTING AND SCORING FOLDING CONTAINER BLANKS

[76] Inventor: Paul W. Smith, 2351 N. 92nd, Omaha, Nebr. 68134

[21] Appl. No.: 188,331

[22] Filed: Sep. 18, 1980

Related U.S. Application Data

[63] Continuation of Ser. No. 5,267, Jan. 22, 1979, abandoned.

[51] Int. Cl.[3] ..... B31B 1/20; B31B 1/25

[52] U.S. Cl. ..... 493/355; 493/61; 493/396

[58] Field of Search ..... 493/396, 355, 354, 61, 493/59; 76/107 C, 107 R

[56] References Cited

U.S. PATENT DOCUMENTS

| | | | |
|---|---|---|---|
| 2,765,716 | 10/1956 | Andersson | 493/396 X |
| 3,059,506 | 10/1962 | Linzell et al. | 76/107 C |
| 3,128,681 | 4/1964 | Miller | 493/396 X |
| 3,137,217 | 6/1964 | Elliott | 493/396 X |
| 3,529,516 | 9/1970 | Dorsey | 493/396 X |
| 3,619,318 | 11/1971 | Shultz | 493/396 |
| 3,735,674 | 5/1973 | Haddock | 493/61X |
| 3,768,950 | 10/1973 | Ihde | 425/398 |
| 3,786,732 | 1/1974 | Forbes, Jr. | 493/354 |
| 3,884,132 | 5/1975 | Snodgrass | 493/396 |
| 4,112,827 | 9/1978 | Kang | 493/355 X |

FOREIGN PATENT DOCUMENTS

| | | | |
|---|---|---|---|
| 1194690 | 6/1970 | United Kingdom | 493/396 |

*Primary Examiner*—James F. Coan

*Attorney, Agent, or Firm*—Zarley, McKee, Thomte

[57] ABSTRACT

A method and apparatus for cutting and scoring plastic and paper box blanks is disclosed wherein a creaseless score line is formed using a score forming strip which is aligned on one die platen and is transferred to the cooperating die platen in mirror image alignment.

7 Claims, 9 Drawing Figures

METHOD AND APPARATUS FOR CUTTING AND SCORING FOLDING CONTAINER BLANKS

This is a continuation application of my earlier filed application, Ser. No. 005,267, filed Jan. 22, 1979, and now abandoned.

BACKGROUND OF THE INVENTION

1. Field of the Invention

This invention relates to the art of forming fold lines by a process of scoring semi-rigid and rigid sheet material to facilitate the formation of plastic and paper boxes and folding cartons.

2. Prior Art

Numerous efforts have been made to form fold lines in semi-rigid materials, such as paper or plastic as well as in rigid materials. The conventional method used to provide the necessary flexibility at the fold line is to press a male portion of a die against an indented female portion to crease the material therebetween. Conventional presses and roller presses are employed in order to provide the necessary pressure.

Another method utilized to score the sheet material is to form a fold line by cutting part way through the material with a scoring blade. In forming conventional paper board boxes or cartons, the blades are unheated and the fold line is formed by what is known as cold scoring. Cold scoring is described, for example, in U.S. Pat. Nos. 3,137,217 and 3,529,516. Another method for creating the score lines can be found in U.S. Pat. No. 3,907,193 in which sheet plastic articles are scored by an apparatus having a die containing the heated scoring blade and a preheated platen.

Another process used for scoring synthetic plastic sheet material may be found in U.S. Pat. No. 3,768,950 in which a female die member is provided along with a male scoring member movable relative to one another in which a resilient material frictionally engages the sheet to immobilize the sheet between the members. The resilient material extends along opposite sides of the rule and above its operable end. The method as shown in U.S. Pat. No. 3,768,950 unfortunately requires a large expense in die making as well as time to prepare the jig.

As all of the prior art methods of scoring the material for a fold require the formation of a crease, they generally employ a grooved female platen and a male die face having a plurality of members which function in conjunction with the female platen to form the crease. Those methods require considerable time and expense in making the die, in setting up the die as well as in positioning the scoring blades.

Accordingly, there is a need for process and apparatus for scoring semi-rigid and rigid material which would eliminate the necessity for having both male and female die faces, thus eliminating the time required for die making as well as the time required for setting up and preparing the press. The instant invention is directed toward those needs.

SUMMARY OF THE INVENTION

This invention is directed to a process for forming the score lines of predetermined configuration in rigid and semi-rigid material, including paper and plastic which results in a well defined score without cracking or rupturing the material and without the necessity for both male and female die faces.

It is therefore an object of this invention to provide a method and apparatus for scoring cartons, boxes and the like without the use of conventional creasing.

It is another object of the invention to provide a method and apparatus for scoring cartons and the like which will adapt to conventional carton cutting die operations without the necessity of additional time and material.

It is another object of this invention to provide a method and apparatus for creating the score in paper and plastic cartons without the necessity of the exact tolerances.

It is another object of the invention to provide a method and apparatus for scoring cartons and the like which is sensitive in adjustment for the materials being scored thereby resulting in greater precision.

It is another object of the invention to provide a method and apparatus for scoring cartons and the like which will eliminate one or more of the male or female die faces and yet utilize conventional presses.

It is yet a further object of the invention to provide a method and apparatus for creating a score in paper and plastic cartons which will create a score not having a raised portion thereby allowing the stacking of a number of scored cartons in the same space as a like number of unscored cartons.

It is yet another object of this invention to provide a method and apparatus for creating a score in paper and plastic cartons which does not break the fibers in the material being scored.

It is yet a still further object of the invention to provide a method and apparatus for creating a score in paper and plastic cartons which conforms to the imperfections of the material to be scored.

It is yet a further object of the invention to provide a method and apparatus for creating a score in paper and plastic cartons which will allow for an increased number of scoring impressions per die face.

It is yet a further object of the invention to provide a method and apparatus for creating a score in paper and plastic cartons which is simple, compact, inexpensive to maintain, reduces the amount of press down time, is durable in use and is extremely reliable.

Other objects, advantages, novel features of the present invention will become apparent in the following detailed description of the invention when considered in conjunction with the accompanying drawings.

BRIEF DESCRIPTION OF THE DRAWINGS

FIG. 7 is a top plan view of a carton or the like;

DESCRIPTION OF THE PREFERRED EMBODIMENT

Figure 1:
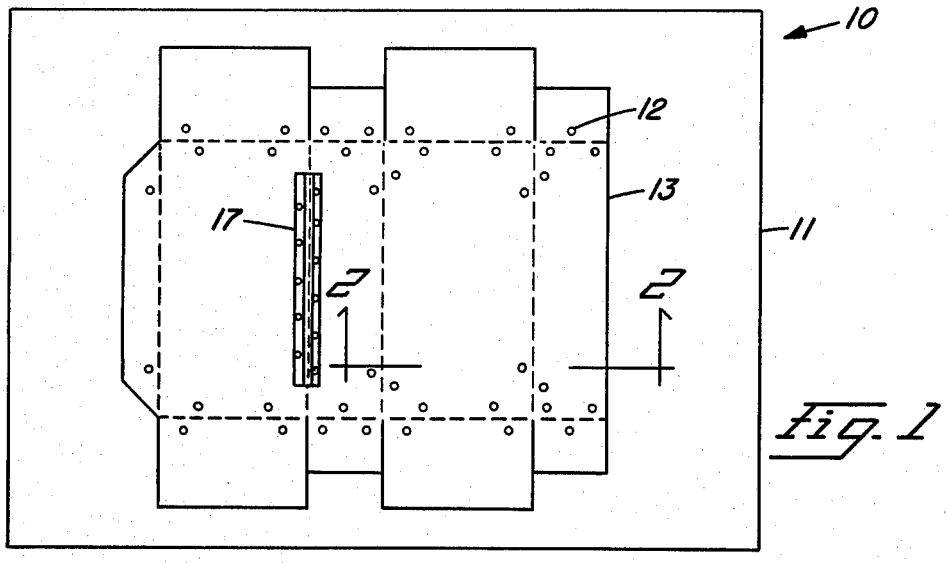
FIG. 1 is a top plan view of the bottom platen wherein the dash lines indicate the desired fold lines for a carton.
Figure 2:
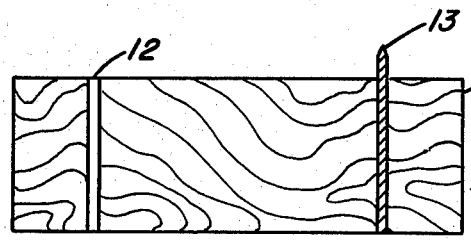
FIG. 2 is a cross-sectional view of the bottom platen taken substantially along the lines 2—2 in FIG. 1.

Referring now to the drawings, and in particular to FIG. 1, the apparatus may be seen generally depicted by the numeral 10. More particularly, the apparatus 10 consists of a die face 11 as generally used in conventional scoring operation. This die face 11 is depicted as being made out of wood, however, any suitable material could be utilized. The die face 11 has a number of holes drilled therein as represented by the hole 12 shown in FIG. 2. Additionally, knife edges 13 are positioned within the die face in a general outline of the carton. The knife edges 13 are embedded in the die face 11 in a conventional manner.

The holes 12 drilled within the die face 11 are fitted with pins (not shown) which extend above the surface of the female platen.

Figure 4:
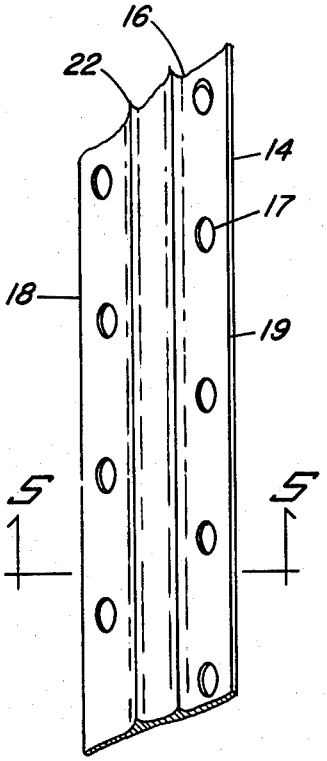
FIG. 4 is a perspective view of the portion of the fold line forming material.

Referring now to FIG. 4, it can be seen that score forming material 14 is provided having a generally flat strip-like appearance with two raised parallel edges 16 and 22. The score forming material 14 when cut to the proper length and having holes 17 drilled along the edges 18 and 19 is placed upon the die face so that the pins (not shown) protruding from the die face pass through the holes 17 in the score forming material 14.

The surface 21 of the score forming material 14 not having the raised parallel protrusions is prepared with an adhesive. The score forming material 14 is placed as shown in FIG. 1 with the protrusions 16 and 22 toward the die face 11.

Figure 3:
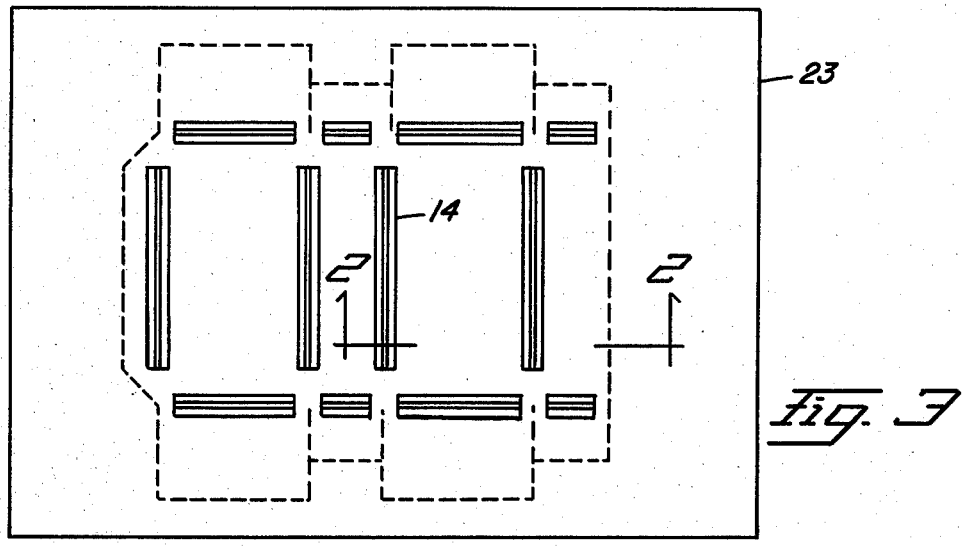
FIG. 3 is a bottom plan view of the top platen wherein the dash lines indicate the outline of the carton.

The die face is then brought into contact with a platen 23 as depicted in FIG. 3. The platen 23 is generally made of a hard material such as steel. When the die face 11 and the platen 23 are brought in contact, the score forming material 14 is transferred to the platen 23. While maintaining platen 23 in alignment with the die face 11 the score forming material 14 is thus transferred onto the platen 23. The die face 11 and platen 23 are then separated, the pins are removed from the holes 12 in the female die face and both the die face 11 and platen 23 are attached to conventional presses.

Figure 6:
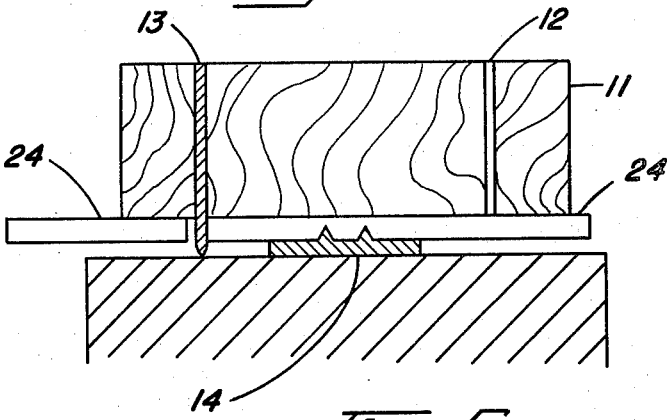
FIG. 6 is a cross-sectional view of both top and bottom platens taken substantially along the lines 2—2 in FIG. 1 and FIG. 3 including a cross-sectional view of the fold line forming material and a sheet of material to be scored.
Figure 7:
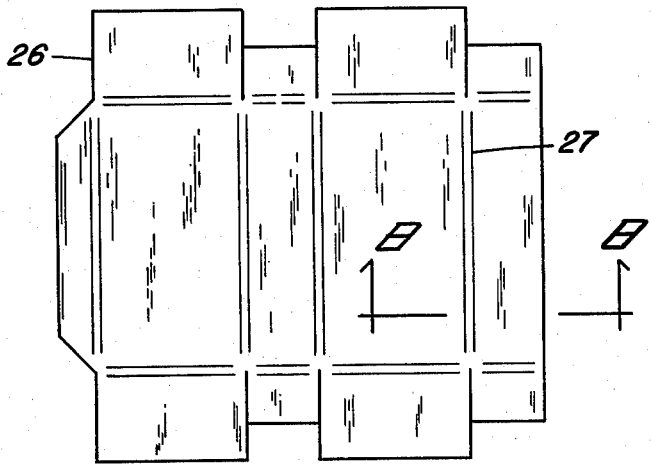
Figure 8:
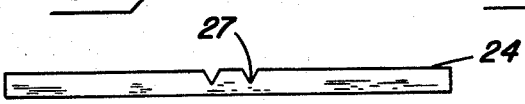
FIG. 8 is a cross-sectional view of the material in FIG. 7 taken substantially along the lines 8—8.

When material such as paper 24 is inserted as depicted in FIG. 6 between the die face 11 and the platen 23, the knife edges 13 cut the carton 26 on its periphery as shown in FIG. 6, and the score forming material 14 makes indentations 27 in the material to be scored 24 as shown in FIGS. 7 and 8.

Figure 5:
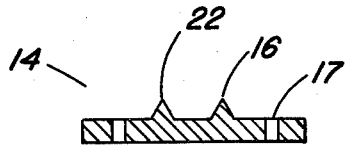
FIG. 5 is a cross-sectional view of the fold line forming the material taken substantially along the lines 5—5 in FIG. 4.

Referring now to FIG. 5 for a cross-sectional view of the score forming material 14, it can readily be seen that when material 14 is pressed against a paper or plastic or similar substances, it would create indentations as shown in FIG. 8 on one side of the material to be scored.

Figure 9:
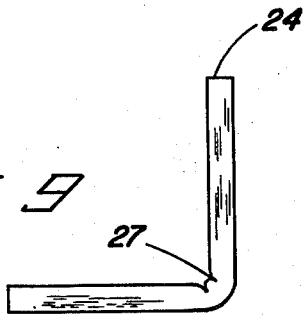
FIG. 9 is the carton material in folded position.

Additionally, when the material is folded as shown in FIG. 9, the indentations 27 delineate the fold and the creation of the carton.

It might be noted that in the event the material 24 to be scored contains imperfections, (not shown), the score lines 27 will be uniform if the die face 11 is a flexible material and if the die face 11 is adjusted by placing shims (not shown) so as to warp the die face 11. The score forming material 14 being flexible will adjust to those alterations in the topography of the die face 11.

I claim:

1. A method for cutting blanks from rigid and semi-rigid material and scoring the blanks to provide creaseless fold lines, comprising, providing a die face having knife edges protruding therefrom defining the general outline of a blank to be cut, providing an elongated generally thin flat score forming material having at least two closely spaced substantially parallel ridges protruding from one surface thereof, aligning and supporting said score forming material on said die face within the general outline defined by said knife edges and with said one surface and ridges of the score forming material facing said die face, aligning a flat platen with said die face, moving said die face and platen together thereby engaging said score forming material with said platen, transferring said score forming material onto said platen in mirror image alignment, separating said die face and platen, placing material to be cut and scored between the die face and platen, and moving said die face and platen together thereby penetrating said knife edges into one side of the material to be cut and scoring the opposite side thereof.

2. The method of claim 1 wherein said step of aligning and supporting the score forming material on said die face comprises fitting pins into a plurality of holes in said die face, providing a plurality of holes in said score forming material positioned for registration with said pins, and placing said score forming material onto said die face so that said pins are received in the holes in said score forming material.

3. The method of claim 2 further comprising applying an adhesive to the opposite side of the score forming material whereby the score forming material adheres to the platen upon movement of the die face and platen together.

4. The method of claim 2 further comprising removing said pins from said die face prior to placing material to be cut between the die face and platen.

5. An apparatus for cutting blanks from rigid and semi-rigid material and scoring said blanks to provide creaseless fold lines, the apparatus comprising, a die face, knife edges positioned on the die face in the general outline of the blank to be cut, an elongated generally flat thin score forming material having opposite surfaces, and at least two closely spaced substantially parallel ridges protruding from one surface, the opposite surface adapted for having an adhesive applied thereto, coacting alignment means on said die face and score forming material, said alignment means being operative to position and support said score forming material on said die face within the general outline defined by said knife edges and with said one surface and ridges of the score forming material facing said die face, and a flat platen alignable with said die face whereby upon application of adhesive to the opposite surface of said score forming material and upon aligned movement of said die face toward said platen, said score forming material is transferred to and positioned on said platen for scoring a blank cut by the knife edges of said die face.

6. The apparatus of claim 5 wherein said coacting alignment means comprises a plurality of holes in said die face and a plurality of holes in said score forming material positioned for registration with the holes in said die face whereby pins may be removably fitted into the holes in said die face and inserted through the holes in said score forming material for positioning and supporting the latter on said die face.

7. The apparatus of claim 5 further comprising an adhesive material on the opposite surface of said score forming material.

* * * * *